US008733891B2

(12) United States Patent
Kanzaki

(10) Patent No.: US 8,733,891 B2
(45) Date of Patent: May 27, 2014

(54) INKJET RECORDING APPARATUS

(71) Applicant: Brother Kogyo Kabushiki Kaisha, Nagoya (JP)

(72) Inventor: Takashi Kanzaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/627,375

(22) Filed: Sep. 26, 2012

(65) Prior Publication Data

US 2013/0135385 A1 May 30, 2013

(30) Foreign Application Priority Data

Nov. 30, 2011 (JP) ..... 2011-261515

(51) Int. Cl.
*B41J 2/165* (2006.01)

(52) U.S. Cl.
USPC ..... 347/33

(58) Field of Classification Search
None
See application file for complete search history.

(56) References Cited

U.S. PATENT DOCUMENTS

| | | | | |
|---|---|---|---|---|
| 6,196,659 | B1 * | 3/2001 | Nitta | 347/33 |
| 2005/0062797 | A1 * | 3/2005 | Kachi | 347/33 |
| 2007/0291073 | A1 | 12/2007 | Jung et al. | |
| 2008/0291239 | A1 | 11/2008 | Kita et al. | |
| 2009/0073219 | A1 * | 3/2009 | Curcio et al. | 347/33 |
| 2009/0184998 | A1 | 7/2009 | Tamaki et al. | |

FOREIGN PATENT DOCUMENTS

| | | | |
|---|---|---|---|
| JP | 2005-199549 | A | 7/2005 |
| JP | 2007-331380 | A | 12/2007 |
| JP | 2008-230100 | A | 10/2008 |
| JP | 2009-172810 | A | 8/2009 |

* cited by examiner

*Primary Examiner* — Alejandro Valencia
(74) *Attorney, Agent, or Firm* — Baker Botts L.L.P.

(57) ABSTRACT

An inkjet head is provided with an ejection surface on which first and second ejection regions having a plurality of ejection openings ejecting different colors of ink are formed in proximity to each other or to partially overlap each other. A first wiping operation in which, after ink is forcibly ejected only from the first ejection region, the first ejection region is wiped by relative movement of the wiping member in a direction from the second ejection region toward the first ejection region, and a second wiping operation in which, after ink is forcibly ejected only from the second ejection region, the second ejection region is wiped by relative movement of the wiping member in a direction from the first ejection region toward the second ejection region are selectively performed.

7 Claims, 10 Drawing Sheets

INKJET RECORDING APPARATUS

CROSS-REFERENCE TO RELATED APPLICATION

The present application claims priority from Japanese Patent Application No. 2011-261515, which was filed on Nov. 30, 2011, the disclosure of which is herein incorporated by reference in its entirety.

BACKGROUND OF THE INVENTION

The present invention relates to an inkjet recording apparatus ejecting different colors of ink from a single inkjet head.

DESCRIPTION OF THE RELATED ART

A known inkjet recording apparatus includes four inkjet heads ejecting different colors of ink, respectively, and a single wiper arranged to wipe the ejection surfaces of four inkjet heads. In such an inkjet recording apparatus, the wiper removes the ink adhering to the ejection surfaces as the wiper moves along a longitudinal direction of the inkjet heads while contacting the four ejection surfaces.

SUMMARY OF THE INVENTION

In the inkjet recording apparatus above, because a single color of ink is ejected from each head and the neighboring ejection surfaces ejecting different colors of ink are separated from each other, ink with one color does not move to ejection openings that ejects ink with another color through the wiper, even if the four ejection surfaces are wiped altogether by one wiper. In short, color mixture does not occur. The inkjet recording apparatus above, however, is disadvantageous in that the apparatus must be large in size because the heads must be separated from one another and also the number of the heads must be identical with the number of the colors.

In this regard, the apparatus is downsized if it has a head which is capable of ejecting two colors of ink, for example. The ejection surface of this head has two ejection regions ejecting different colors of ink, respectively. Furthermore, disposing the ejection regions in proximity to one another or to partially overlap one another contributes to the downsizing of the head. When such a head is employed, as the ejection surface of the head is wiped by the wiper along the longitudinal direction (i.e., direction in which the ejection openings are lined up), inks with different colors move through the wiper, with the result that color mixture occurs at the ejection openings of the ejection regions.

An object of the present invention is to provide an inkjet recording apparatus in which color mixture is restrained at ejection openings ejecting different colors of ink.

An inkjet recording apparatus of the present invention includes: an inkjet head having an ejection surface on which a first ejection region where a plurality of ejection openings ejecting ink are disposed at equal intervals in one direction and a second ejection region where a plurality of ejection openings ejecting ink with a color different from a color of the ink ejected from the first ejection region are disposed at equal intervals in the one direction are formed to be in proximity to each other or to partially overlap each other in the orthogonal direction orthogonal to the one direction; a wiping unit including a wiping member that wipes the ejection surface and a moving mechanism that moves at least one of the wiping member, and the inkjet head relative to each other in the orthogonal direction along the ejection surface while keeping the wiping member to contact the ejection surface; a forcible ejection unit that selectively and forcibly ejects the ink from the first ejection region and the second ejection region by supplying the ink to the inkjet head; and a controller that controls the wiping unit and the forcible ejection unit, the controller selectively performing: a first wiping operation in which, after the ink is forcibly ejected only from the first ejection region, the first ejection region is wiped by relative movement of the wiping member in a direction from the second ejection region toward the first ejection region; and a second wiping operation in which, after the ink is forcibly ejected only from the second ejection region, the second ejection region is wiped by relative movement of the wiping member in a direction from the first ejection region toward the second ejection region.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
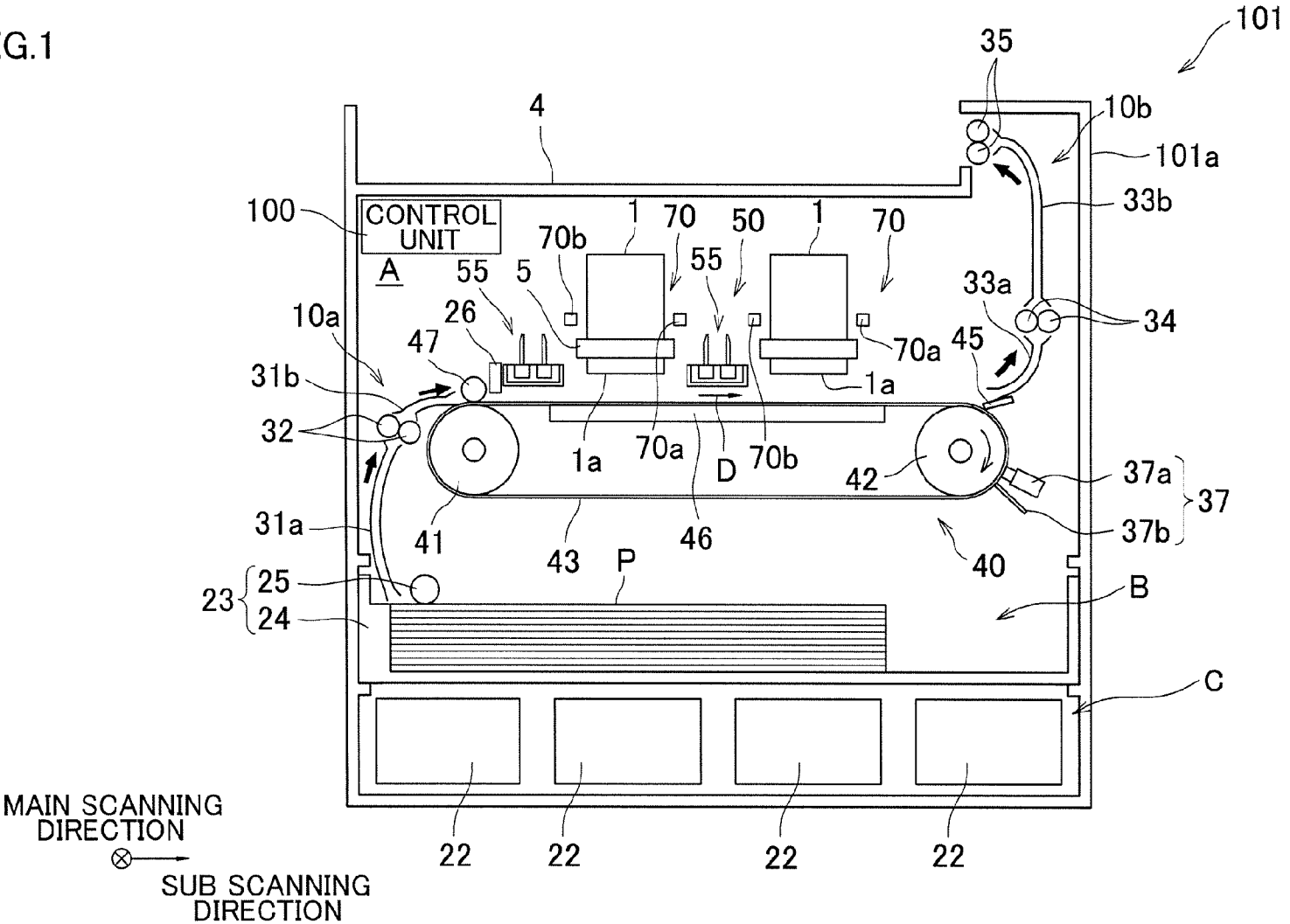
FIG. 1 is a schematic profile of the internal structure of an inkjet printer according to one embodiment of the present invention.

To begin with, referring to FIG. 1, the overall structure of an inkjet printer 101 according to an embodiment of the present invention will be described.

The printer 101 has a rectangular parallelepiped chassis 101*a*. Above the top plate of the chassis 101*a* is provided a sheet discharge section 4. The internal space of the chassis 101*a* is divided into spaces A, B, and C from top to bottom. In the spaces A and B is formed a sheet conveyance path connecting a sheet feeding section 23 with the sheet discharge section 4, and a sheet P is conveyed along the black thick arrow in FIG. 1. In the space A, image formation on the sheet P and conveyance of the sheet P to the sheet discharge section 4 are carried out. In the space B, the sheet P is supplied to the conveying path. From the space C, ink is supplied to two inkjet heads 1 in the space A.

In the space A are provided components such as two inkjet heads (hereinafter, heads) 1, a conveyance mechanism 40, two guide units 10*a* and 10*b* guiding the sheet P, a sheet sensor 26, a heads elevating mechanism 36 (see FIG. 8), a wiping mechanism 50, two groups of cleaning members (cleaning units) 70, a cleaner unit 37, and a control unit 100.

Each head 1 ejects two colors of ink. The head 1 on the upstream in the sheet conveyance direction ejects magenta ink and cyan ink. The head 1 on the downstream ejects yellow ink and black ink. These two heads 1 are aligned in the sub-scanning direction at a predetermined interval, and are supported by a chassis 101*a* via head holders 5. The lower surface of each head 1 is an ejection surface 1*a* where a plurality of ejection openings 108 (see FIG. 3) are disposed.

Figure 2:
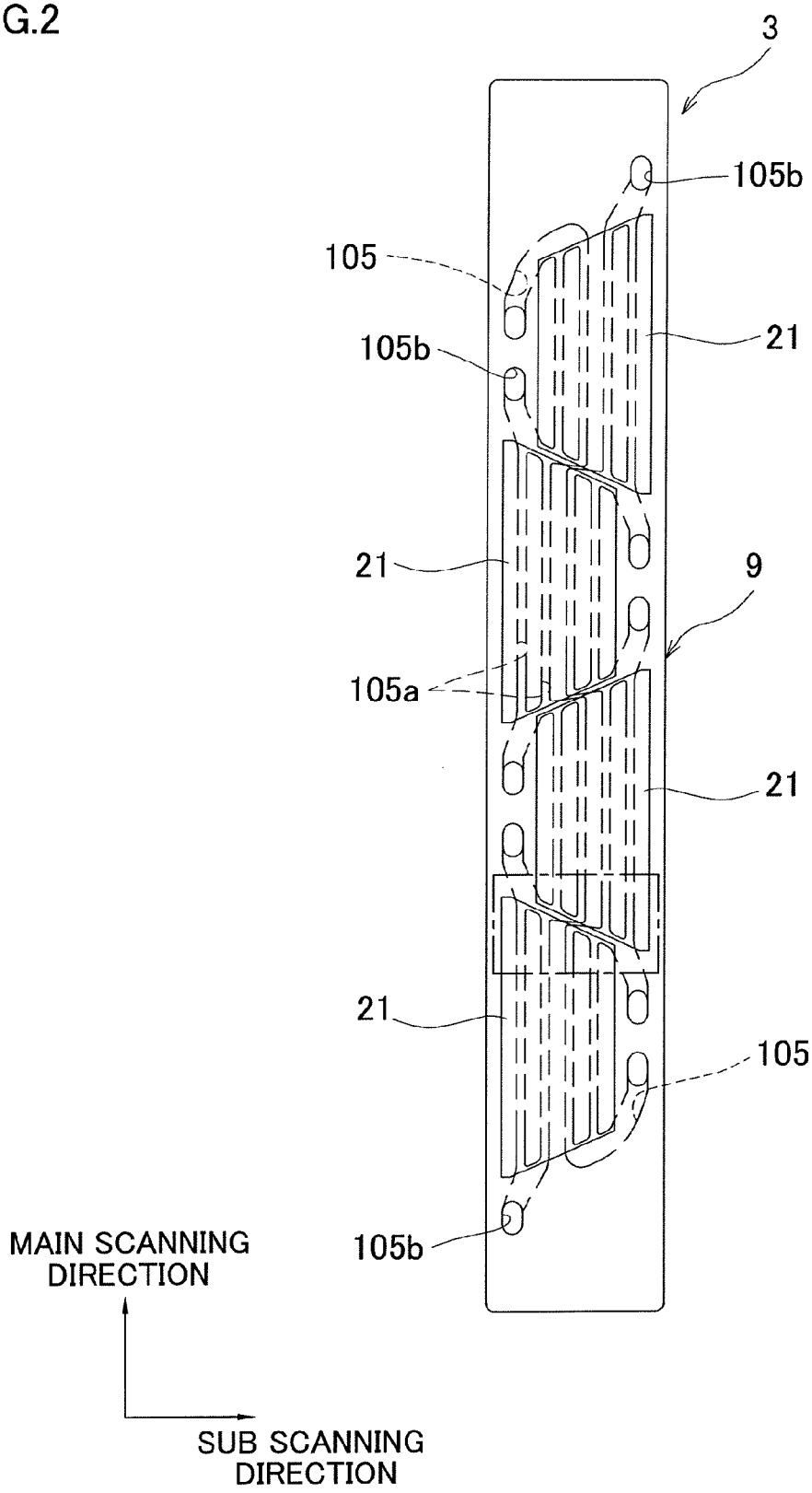
FIG. 2 is a plan view of the head main body of the head in the printer of FIG. 1.

Each head 1 is a laminated body in which components such as a reservoir unit, a flexible printed circuit board (FPC), and a control substrate are laminated in addition to a head main body 3 constituted by a passage unit 9 and an actuator unit 21 (see FIG. 2). A signal adjusted by the control substrate is converted to a drive signal by a driver IC on the FPC, and is then output to the actuator units 21. As the actuator units 21 are driven, ink supplied from the reservoir unit is ejected through the ejection openings 108.

The conveyance mechanism 40 includes two belt rollers 41 and 42, a conveyance belt 43, a platen 46, a nipping roller 47, and a peeling plate 45. The conveyance belt 43 is an endless belt stretched between the rollers 41 and 42. The platen 46 is disposed to oppose the two heads 1 and supported from the inside the upper part of the conveyance belt 43. The belt roller 42 is a drive roller for moving the conveyance belt 43. The belt roller 42 is rotated clockwise in FIG. 1 by an unillustrated motor. The belt roller 41 is a driven roller driven by the movement of the conveyance belt 43. The nipping roller 47 presses a sheet P conveyed from the sheet feeding section 23 onto the outer circumferential surface of the conveyance belt 43. The sheet P is supported on the conveyance belt 43 by a silicon layer (a weakly adhesive layer coating the outer circumferential surface), and is conveyed toward the heads 1. The peeling plate 45 peels the conveyed sheet P off from the conveyance belt 43 and guides the sheet P to the sheet discharge section 4 on the downstream.

The two guide units 10*a* and 10*b* are provided to sandwich the conveyance mechanism 40. The guide unit 10*a* on the upstream in the conveyance direction includes two guides 31*a* and 31*b* and a feed roller pair 32 and connects the sheet feeding section 23 with the conveyance mechanism 40. The sheet P for image formation is conveyed toward the conveyance mechanism 40. The guide unit 10*b* on the downstream in the conveyance direction includes two guides 33*a* and 33*b* and two feed roller pairs 34 and 35 and connects the conveyance mechanism 40 with the sheet discharge section 4. The sheet P after the image formation is conveyed toward the sheet discharge section 4.

The sheet sensor 26 is disposed on the upstream of the heads 1 to detect the leading end of the conveyed sheet P. The detection signal output upon the detection is used for synchronizing the driving of the heads 1 with the driving of the conveyance mechanism 40, and therefore an image is formed with desired resolution and speed.

The heads elevating mechanism 36 moves up or down the head holders 5. With this, the two heads 1 move between a printing position and a retracted position above the printing position. At the printing position (see FIG. 10A and FIG. 10C), as shown in FIG. 1, each head 1 opposes the conveyance belt 43 with a distance suitable for printing. At the retracted position (see FIG. 10B and FIG. 10D), each head 1 is distanced from the conveyance belt 43 more than it is at the printing position. At the retracted position, a later-described wiper unit 55 is movable in the space between the heads 1 and the conveyance belt 43, and the ejection surfaces 1*a* are wiped by the moving wiper unit 55.

Figure 6:
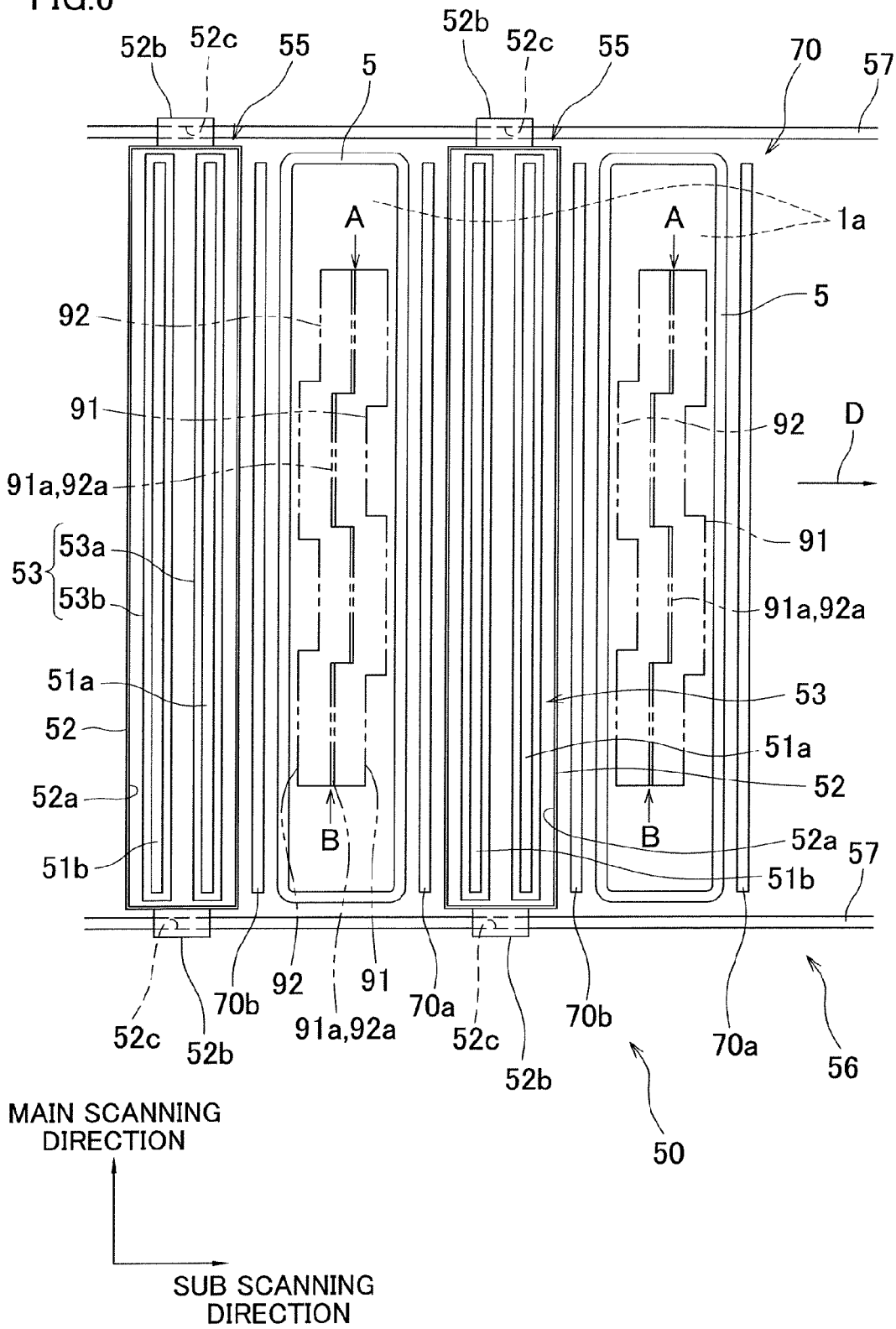
FIG. 6 is a plan view of the head and the wiping mechanism in the printer of FIG. 1.
Figure 10A:
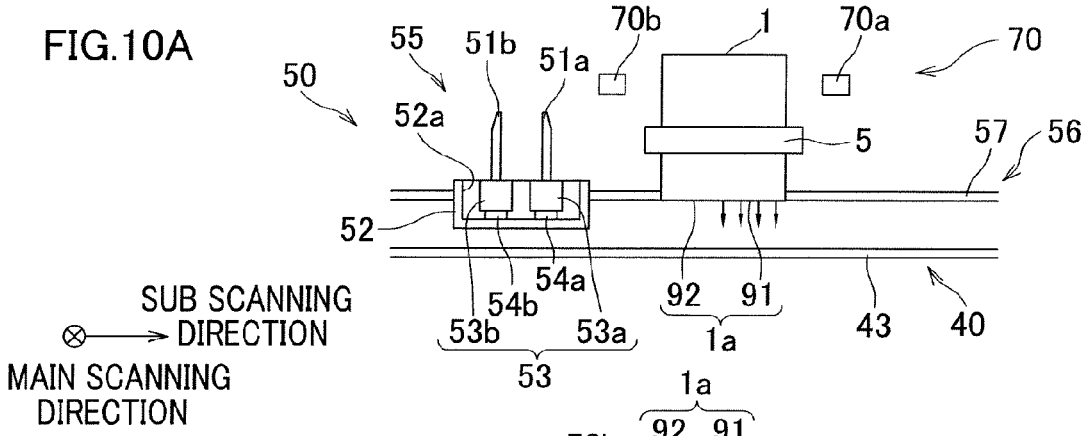
FIG. 10A to FIG. 10D are profiles serially showing a wiping operation executed by the printer of FIG. 1.

The wiping mechanism 50 as a wiping unit includes, as shown in FIG. 1, FIG. 6, and FIG. 10A, two wiper units (wiping members) 55 and a wiper unit moving mechanism 56 causing the wiper units 55 to reciprocate along the sub-scanning direction. The wiper units 55 are disposed for the respective ejection surfaces 1*a* and are on the upstream of the corresponding heads 1 in the conveyance direction.

The wiper unit 55 includes two wipers 51*a* and 51*b*, a support housing 52, and a wipers elevating mechanism 53. The wipers 51*a* and 51*b* are, as shown in FIG. 6, flat elastic members (such as rubber blades), and are substantially identical in length with the ejection surface 1*a* in the main scanning direction which is in parallel to the horizontal surface and orthogonal to the sub-scanning direction. While in the present embodiment the wipers 51*a* and 51*b* are flat, the wipers may be corrugated along the main scanning direction in accordance with the shape of later-described ejection regions 91 and 92.

The support housing 52 is provided with an open-top concave portion 52*a*. At the bottom surface of the concave portion 52*a* of the support housing 52, two wipers 51*a* and 51*b* are supported via the wipers elevating mechanism 53. With this arrangement, the support housing 52 is able to receive ink removed from the ejection surface 1*a* by the wipers 51*a* and 51*b*. At the both ends of the support housing 52 in the main scanning direction, protruding blocks 52*b* are formed, respectively. Through each protruding block 52*b*, a hole 52*c* is formed to penetrate the protruding block 52*b* in the sub-scanning direction. Among the two holes 52*c*, a female screw is formed on the inner surface of one hole 52*c*.

The wipers elevating mechanism (wiper moving mechanism) 53 includes two elevators 53*a* and 53*b* for moving up or down the respective wipers 51*a* and 51*b*. The elevators 53*a* and 53*b* in the present embodiment are constituted by solenoids, and the leading ends of moving cores 54*a* and 54*b* are fixed to the bottom surface of the concave portion 52*a* (see FIG. 10A). The wiper 51*a* is fixed to the upper surface of the elevator 53*a* and the wiper 51*b* is fixed to the upper surface of the elevator 53*b*. Under the control of the control unit 100, the wipers elevating mechanism 53 moves the wipers 51*a* and 51*b* to either a retracted position or a contact position above the retracted position, as the elevators 53*a* and 53*b* are selectively driven. At the contact position, the leading ends of the wipers 51*a* and 51*b* are farthest from the bottom surface of the concave portion 52*a* and are able to contact the ejection surface 1*a* of the head 1 at the retracted position and a later-described cleaning member 70 (see the wiper 51*a* in FIG. 10B and the wiper 51*b* in FIG. 10D). At the retracted position, the leading ends of the wipers 51*a* and 51*b* are close to the bottom surface of the concave portion 52*a* in comparison with the contact position. The leading ends are lower than the ejection surface 1*a* of the head 1 at the retracted position and the cleaning member 70 and do not contact them (see the wiper 51*b* in FIG. 10B and the wiper 51*a* in FIG. 10D).

The wiper unit moving mechanism 56 is constituted by a pair of guides 57 (e.g., round bars) extending in the sub-scanning direction and a drive motor (not illustrated). The paired guides 57 are bars inserted into the holes 52*c* and sandwich the head 1 in the main scanning direction. One guide 57 has a male screw on its outer circumferential surface and is screwed into the female screw on the hole 52*c*. This guide 57 receives the rotational force of the drive motor. The other guide 57 slides on the inner circumferential surface of the other hole 52*c*.

As the drive motor rotates forward and backward, the wiper unit 55 reciprocates along the guides 57. As shown in FIG. 10A, a space around the left end portion of the head 1 is a standby position of the wiper unit 55. In the first wiping operation, the wiper 51*a* moves rightward in the figure while contacting the ejection surface 1*a* of the head 1 at the retracted position, so as to wipe the ejection surface 1*a* (see FIG. 10B). In the second wiping operation, the wiper 51*b* moves leftward in the figure while contacting the ejection surface 1*a* of the head 1 at the retracted position, so as to wipe the ejection surface 1*a* (see FIG. 10D).

As shown in FIG. 6, the cleaning member 70 is provided for each head 1, and includes a pair of absorbents 70*a* and 70*b*. The paired absorbents 70*a* and 70*b* sandwich the corresponding head 1 in the sub-scanning direction. Each of the absorbents 70*a* and 70*b* is substantially identical in length with the wipers 51*a* and 51*b* in the main scanning direction. Each of the absorbents 70*a* and 70*b* is made of a porous material (such as sponge). The absorbents 70*a* and 70*b* are disposed so that the lower surfaces thereof are flush with the ejection surface 1*a* of the head 1 at the retracted position. As the absorbents 70*a* and 70*b* contact the wipers 51*a* and 51*b*, respectively, the ink adhering to the wipers 51*a* and 51*b* is removed.

The cleaner unit 37 includes a cleaning solution applying member 37*a*, a blade 37*b*, and a cleaner moving mechanism 37*c* (see FIG. 8) and cleans the outer circumferential surface of the conveyance belt 43. As shown in FIG. 1, the cleaner unit 37 is provided below and to the right of the conveyance belt 43 to oppose the belt roller 42. The cleaning solution applying member 37*a* is composed of a porous material (such as sponge) and a supporting member supporting the porous material, and the blade 37*b* is constituted by a blade-shaped elastic material (such as rubber). Both of these components are able to contact the entire width of the conveyance belt 43. The cleaner moving mechanism 37*c* causes the cleaning solution applying member 37*a* and the blade 37*b* to contact or to be separated from the outer circumferential surface of the conveyance belt 43. In the cleaning operation, a cleaning solution is applied from the porous material to the outer circumferential surface, and the dust and the cleaning solution are scraped off from the outer circumferential surface by the downstream blade 37*b*.

In the space B is provided the sheet feeding section 23. The sheet feeding section 23 includes a sheet feeding tray 24 and a pickup roller 25. The sheet feeding tray 24 is arranged to be detachable to the chassis 101*a*. The sheet feeding tray 24 is an open-top box and capable of storing a plurality of sheets P. The pickup roller 25 sends out the topmost one of the sheets P in the sheet feeding tray 24.

The sheet conveyance direction D in which the sheets are conveyed by the conveyance mechanism 40 is in parallel to the sub-scanning direction.

In the space C, four cartridges 22 are provided to be detachable to the chassis 101*a*. The four cartridges 22 store magenta ink, cyan ink, yellow ink, and black ink, respectively. Each cartridge 22 is connected to a head 1 via a tube (not illustrated) and the pump 38 (see FIG. 8). Each pump 38 is on standby unless the ink is forcibly supplied to the head 1. In the standby state, ink supply from the pump 38 to the head 1 is not obstructed.

Now, the control unit 100 will be described. The control unit 100 controls the overall operations of the printer 101 by controlling the components of the printer 101. The control unit 100 controls the image forming operation based on a printing command input from an external apparatus (such as a computer connected to the printer 101). More specifically, the control unit 100 controls the operation to convey the sheet P, the ink ejection operation in sync with the conveyance of the sheet P, or the like.

The control unit 100 controls the operations of the sheet feeding section 23, the conveyance mechanism 40, and the feed roller pairs 32, 34, and 35 based on the printing command input from the external apparatus. The sheet P sent out from the sheet feeding tray 24 is guided to the upstream guide unit 10*a* and conveyed to the conveyance mechanism 40. When the sheet P conveyed by the conveyance mechanism 40 passes through the position below the head 1, ink is ejected from the head 1. With this, a desired image is formed on the sheet P. The sheet P on which the image has been formed is peeled off from the conveyance belt 43 by the peeling plate 45, and then guided by the downstream guide unit 10*b* and ejected to the sheet discharge section 4 from an upper part of the chassis 101*a*.

In addition to the above, the control unit 100 controls a maintenance operation. In the maintenance operation, the ink ejection property of the head 1 is recovered or maintained and preparation for the recording is carried out. More specifically, the maintenance operation includes a purging operation, a wiping operation for wiping the ejection surface 1*a*, and a cleaning operation for cleaning the conveyance belt 43.

The purging operation includes a first purging operation and a second purging operation. In the first purging operation, the pump 38 is driven so that ink is forcibly ejected through the ejection openings 108 in a later-described ejection region 91. In the second purging operation, the pump 38 is driven so that ink is forcibly ejected through the ejection openings 108 in a later-described ejection region 92.

The wiping operation includes a first wiping operation and a second wiping operation. The first wiping operation is carried out after the first purging operation. In this operation the ejection surface 1*a* is wiped by the wiper 51*a*. The second wiping operation is carried out after the second purging operation. In this operation the ejection surface 1*a* is wiped by the wiper 51*b*. As such, residual ink and foreign matters on the ejection surface 1*a* are removed. In the cleaning operation, the conveyance belt 43 is wiped by the cleaner unit 37. The cleaning operation is carried out after the purging operation. In this operation ink and foreign matters on the conveyance belt 43 are removed.

Now, the head 1 will be detailed with reference to FIG. 2 to FIG. 7. Pressure chambers 110, apertures 112, and ejection openings 108 are depicted by full lines even if they are below the actuator units 21.

Figure 3:
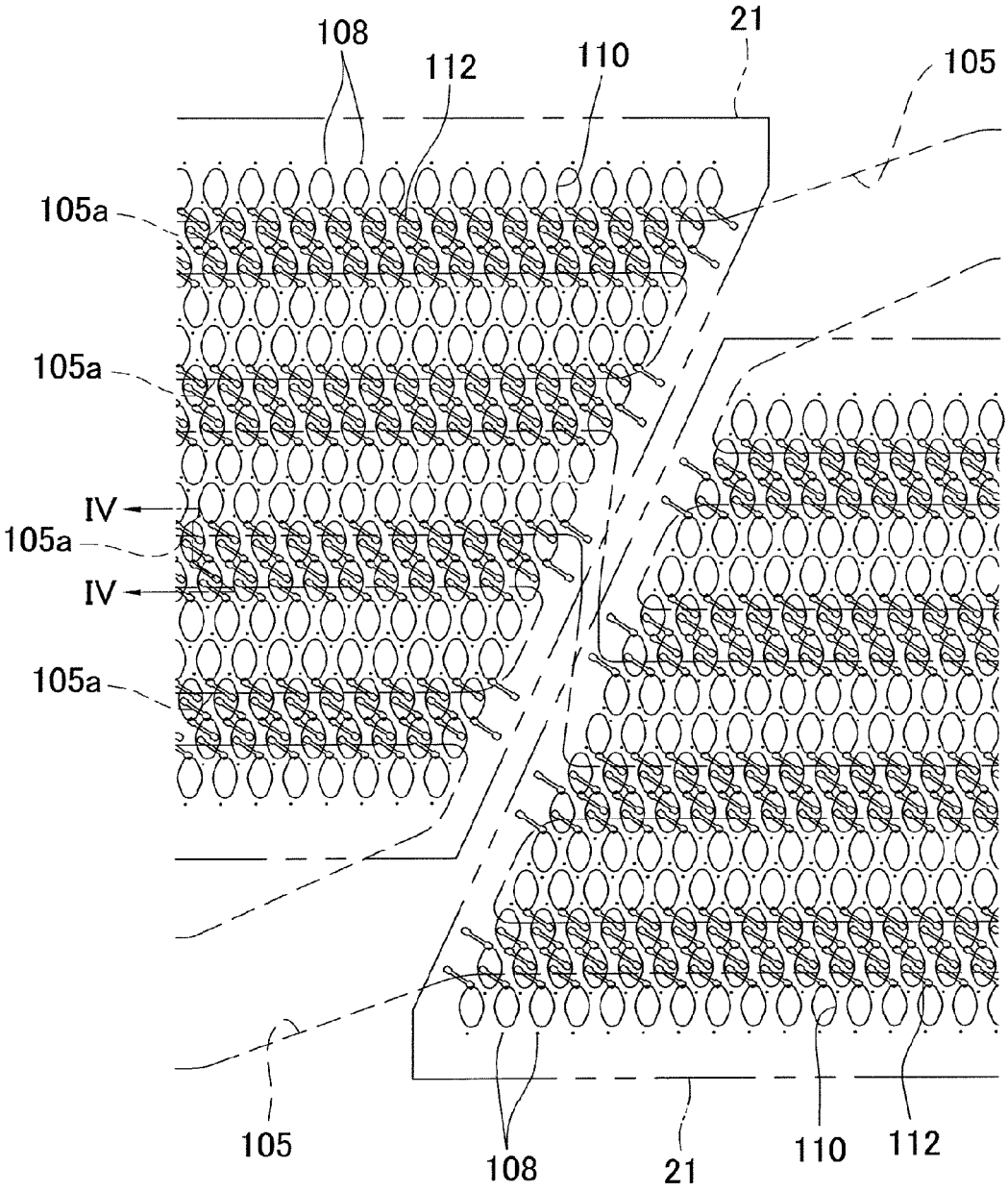
FIG. 3 is an enlarged view of the region surrounded by the dashed line in FIG. 2.
Figure 4:
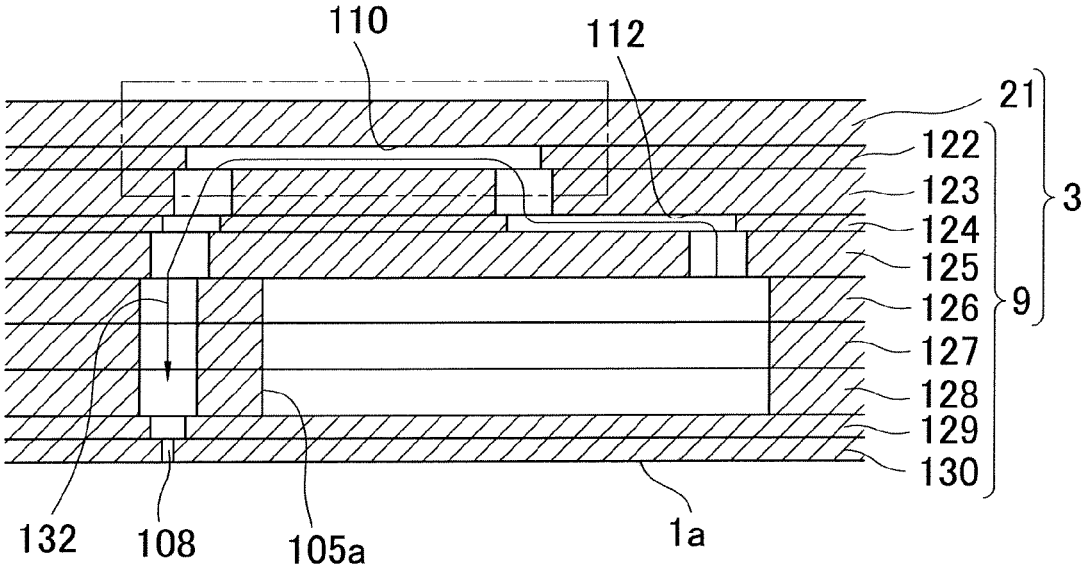
FIG. 4 is a partial cross section taken along the IV-IV line in FIG. 3

As shown in FIG. 4, the passage unit 9 is a laminated body formed by laminating nine stainless-steel plates 122 to 130. On the upper surface of the passage unit 9, as shown in FIG. 2, ten ink supply openings 105*b* are formed. In the passage unit 9, as shown in FIG. 2 to FIG. 4, manifold passages 105 each having an ink supply opening 105*b* at one end and a plurality of sub-manifold passages 105*a* are formed. The sub-manifold passages 105*a* branch from the manifold passage 105 and extend in the main scanning direction, and connect the manifold passages 105, which are connected to ink supply openings 105*b* neighboring to each other in the main scanning direction, with each other. In other words, while five ink supply openings 105*b* aligned in the main scanning direction are connected with one another, these ink supply openings 105*b* are not connected with five ink supply openings 105*b* belonging to another row. As such, according to the present embodiment, the ink supply openings 105*b* of the passage unit 9 are grouped into rows, and inks with different colors are supplied to the respective rows from the reservoir unit.

Each sub-manifold passage 105*a* is, as shown in FIG. 4, connected to a plurality of individual ink flow passages 132. The individual ink flow passage 132 connects the outlet of the sub-manifold passage 105*a* with the ejection opening 108 via the aperture 112 and the pressure chamber 110. The lower surface of the passage unit 9 functions as the ejection surface 1*a* and a plurality of ejection openings 108 are formed thereon in a matrix manner.

Figure 7:
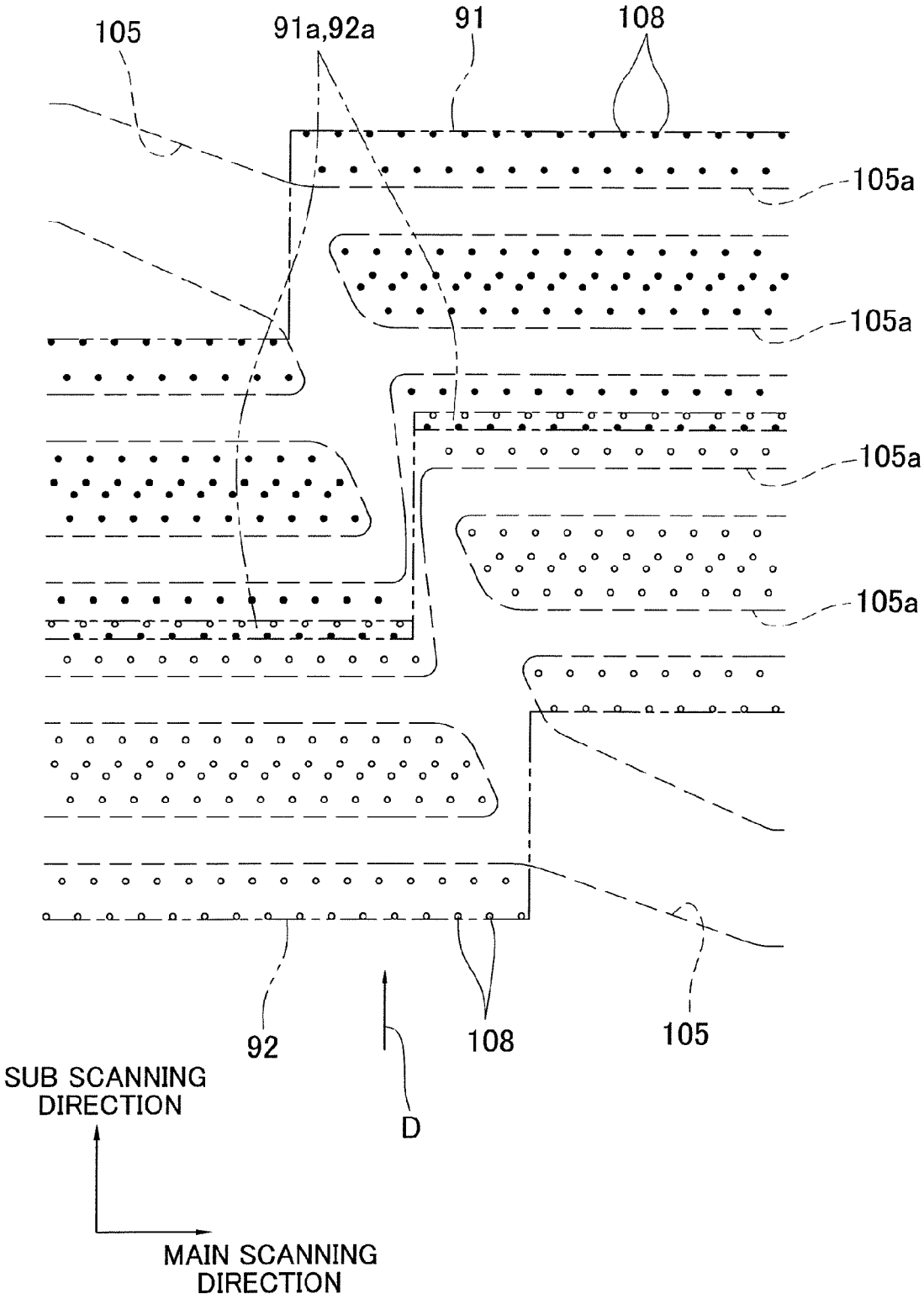
FIG. 7 is a partial enlarged view of the ejection surface of the head.

On the ejection surface 1*a*, as shown in FIG. 6 and FIG. 7, two ejection regions 91 and 92 are defined. In FIG. 7, the ejection region 91 is a region where a plurality of ejection openings 108 (indicated by black dots) ejecting ink with a color (first color) are gathered. The ejection region 92 is a region where a plurality of ejection openings 108 (indicated by white dots) ejecting ink with another color different from the ink ejected from the ejection region 91 are gathered. The outer edge of the ejection region 91 is defined as the shortest circumscribing loop that encloses therein the ejection openings 108 ejecting the ink with the first color and circumscribes at least one of the ejection openings 108. The outer edge of the ejection region 92 is defined in a similar manner.

These ejection regions 91 and 92 are basically corrugated in the main scanning direction. More specifically, as ejection opening groups each forming a trapezoid are staggered in the main scanning direction, each of the ejection regions 91 and 92 is formed. The ejection regions 91 and 92 overlap each other in the sub-scanning direction at parts 91*a* and 92*a*. Except these overlapped parts, the most of the ejection region 91 is downstream the ejection region 92 in the conveyance direction.

While in the present embodiment the ejection regions 91 and 92 partially overlap each other, according to a variation two ejection regions may be in proximity to each other without overlapping each other in the sub-scanning direction.

The ejection openings 108 in each of the ejection regions 91 and 92 are aligned at predetermined intervals in the main scanning direction, in the present embodiment, the intervals of the ejection openings correspond to 300 dpi. In the sub-scanning direction, a single ejection opening 108 of the ejection region 91 is disposed to overlap a single ejection opening 108 of the ejection region 92. Because the printer 101 is a color printer and another head 1 is provided, one ejection opening 108 overlaps three other ejection openings 108 in the sub-scanning direction, and inks with different colors are ejected through the respective ejection openings.

The reservoir unit is connected to two cartridges 22 via pumps 38, respectively, and inks with two colors are supplied thereto. The reservoir unit is a passage member in which ink passages are formed for respective colors. The reservoir of the ink passage stores ink supplied to the passage unit 9. As shown in FIG. 2 to FIG. 4, the ink in the reservoir unit is supplied from the ink supply opening 105*b* to the passage unit 9. In so doing, ink with a single color is supplied for each row from the reservoir unit to the ink supply opening 105*b*.

Figure 8:
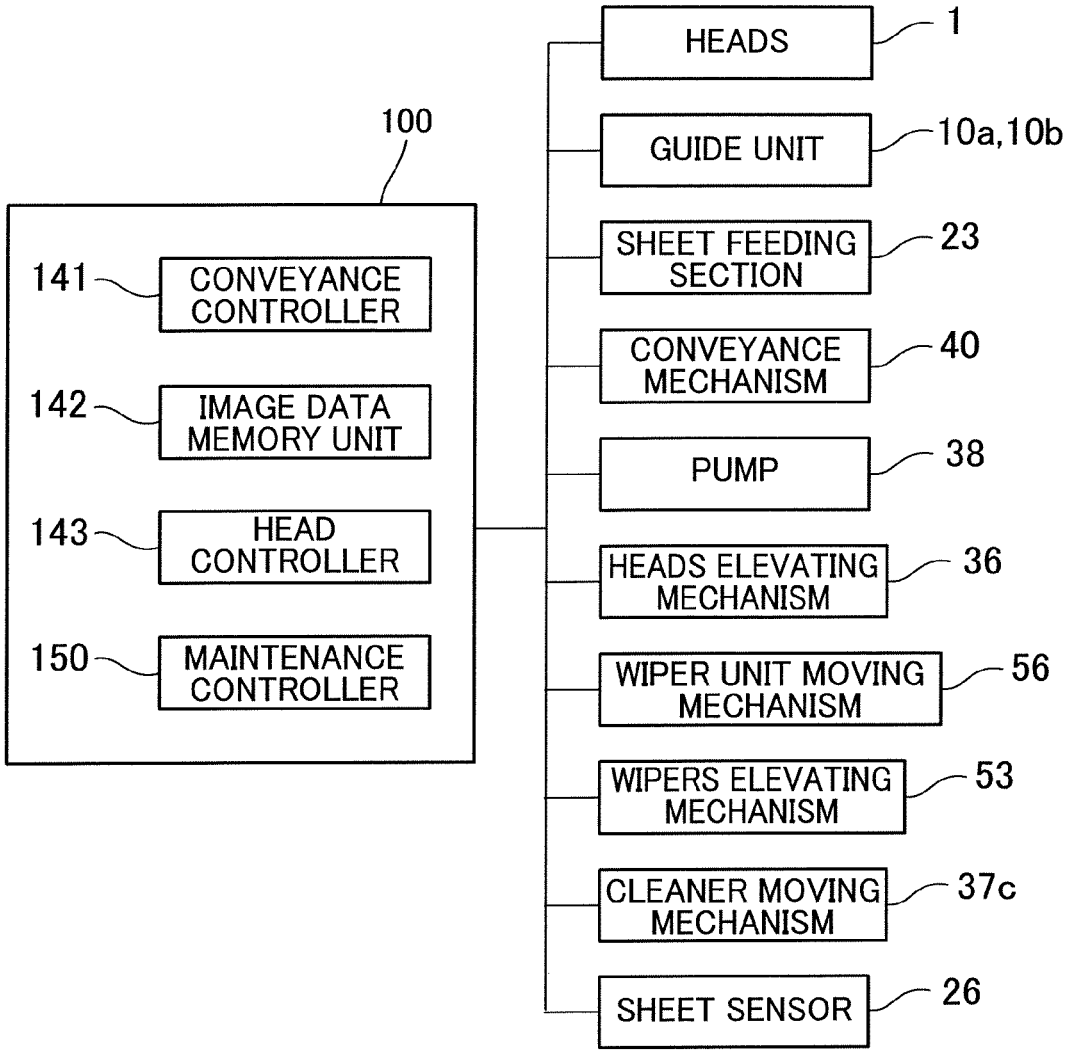
FIG. 8 is a block diagram of the control unit of FIG. 1.

The pumps 38 are provided for the respective cartridges 22 to forcibly supply ink to the passage unit 9 via the reservoir unit. FIG. 8 shows one of these pumps 38.

Now, the actuator units 21 will be described. The actuator units 21 are fixed to the upper surface of the passage unit 9 to constitute the head main body 3. As shown in FIG. 2, the four actuator units 21 are each trapezoidal in plan view and staggered in the main scanning direction in such a way as to avoid the ink supply openings 105*b*.

Figure 5:
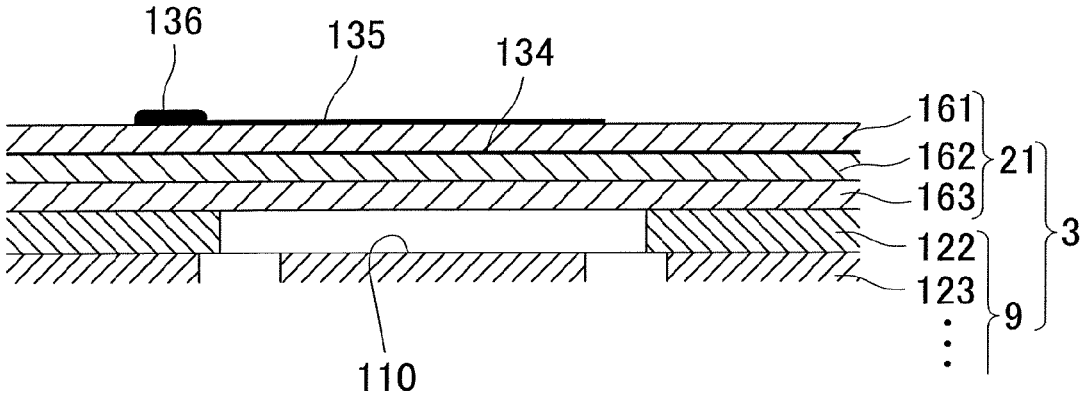
FIG. 5 is an enlarged view of the region surrounded by the dashed line in FIG. 4.

Each actuator unit 21 is made of lead zirconate titanate (PZT) ceramics having ferroelectricity and is composed of three piezoelectric layers 161 to 163. The topmost piezoelectric layer 161 is polarized in the thickness direction and is sandwiched between a plurality of individual electrodes 135 on the upper surface and a common electrode 134 covering the entirety of the lower surface. As shown in FIG. 5, the individual electrode 135 opposes the pressure chamber 110 for its most part and a part of the electrode not opposing the pressure chamber is connected to an individual land 136. This structure is formed for each pressure chamber 110 and functions as an individual actuator. In other words, each actuator unit 21 has actuators identical in number with the pressure chambers 110, and each actuator selectively applies ejection energy to the ink in the pressure chamber 110.

Now, how the actuator unit 21 is driven will be described. Each actuator is a so-called unimorph actuator. A part of the piezoelectric layer 161 which part is sandwiched between the electrodes 134 and 135 contracts in directions (planar directions) orthogonal to the polarization direction, when an electric field is applied thereto along the polarization direction. As a result, because of a difference in the degree of distortion between the part and the underlying piezoelectric layers 162 and 163, the part sandwiched between the individual electrode 135 and the pressure chamber 110 bulges toward the pressure chamber 110. On this account, a pressure (ejection energy) is applied to the ink in the pressure chamber 110, with the result that an ink droplet is ejected through the ejection opening 108.

In the present embodiment, the individual electrode 135 receives a predetermined positive electric potential in advance. The individual electrode 135 is reduced to the ground potential when the drive signal is supplied, and then returns to the predetermined electric potential at a predetermined timing. This is so-called "fill before fire" driving. When the ground potential is set, the capacity of the pressure chamber 110 increases and hence ink is sucked into the pressure chamber 110. At the timing of the subsequent return to the predetermined electric potential, the capacity of the pressure chamber 110 decreases (i.e., the ink pressure increases) and hence an ink droplet is ejected through the ejection opening 108.

Now, the control unit 100 will be described with reference to FIG. 8. The control unit 100 includes a CPU (Central Processing Unit), a ROM (Read Only Memory) rewritably storing programs executed by the CPU and data used by the programs, and a RAM (Random Access Memory) temporarily storing data when a program is executed. The functional blocks constituting the control unit 100 are constructed by the cooperation of the hardware above and software in the ROM. As shown in FIG. 8, the control unit 100 includes a conveyance controller 141, an image data memory unit 142, a head controller 143, and a maintenance controller 150.

Based on a printing command supplied from an external apparatus, the conveyance controller 141 controls the operations of the sheet feeding section 23, the guide units 10*a* and 10*b*, and the conveyance mechanism 40 so that the sheet P is conveyed at a predetermined speed along the conveyance direction. The image data memory unit 142 stores image data (ink discharge data) included in the printing command from the external apparatus.

The head controller 143 causes each head 1 to eject ink in image formation and maintenance. In the image formation, the head controller 143 controls the ink ejection from each head 1 so that ink is ejected onto the sheet P based on the image data stored in the image data memory unit 142. The ink ejection timing is determined based on the detection of the leading end of the sheet P by the sheet sensor 26, and is a timing at which a predetermined time has elapsed after the detection. The predetermined time above is calculated for each head 1 by dividing, by the conveyance speed of the sheet P, the distance along the conveying path between the position where the sheet sensor 26 detects the leading end of the sheet P and the most upstream ejection opening 108.

The maintenance controller 150 controls the conveyance mechanism 40, the heads elevating mechanism 36, the wiper unit moving mechanism 56, the cleaner moving mechanism 37*c*, the wipers elevating mechanism 53, and the pumps 38, in a maintenance operation including a purging operation, a first wiping operation, a second wiping operation, and a cleaning operation.

Figure 9:
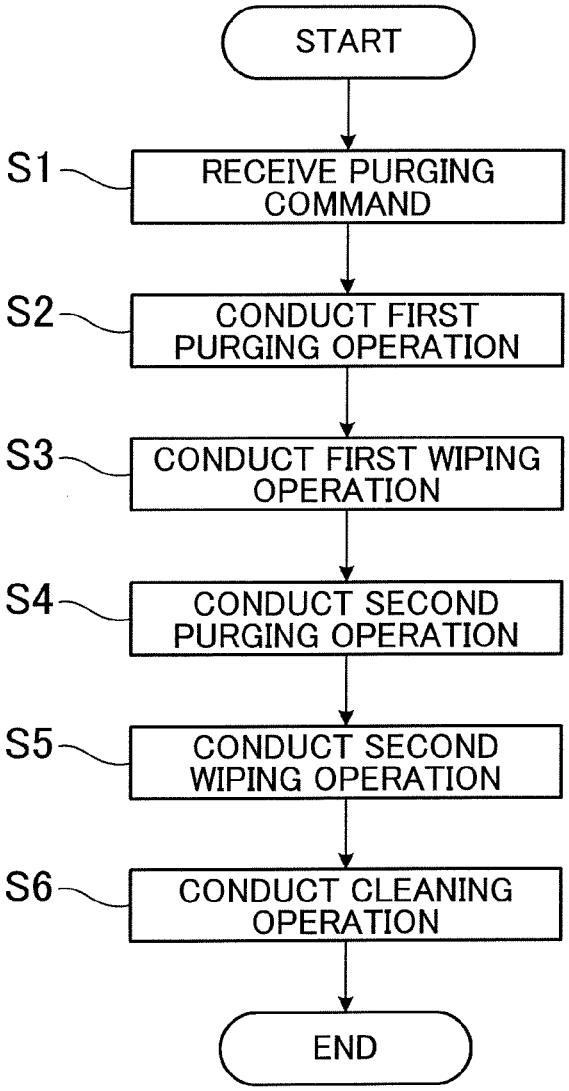
FIG. 9 is a flowchart of a maintenance operation executed by the printer of FIG. 1.

Now, referring to FIG. 9, an example of the maintenance operation (purging operation, wiping operation, and cleaning operation) of the printer 101 will be described.

To begin with, the control unit 100 receives a purging command (S1). At this stage each head 1 is at the printing position. Receiving the purging command, the maintenance controller 150 executes the first purging operation and then executes the first wiping operation. Thereafter, the second purging operation is executed and the second wiping operation is executed.

More specifically, the maintenance controller 150 controls the pumps 38 to, as shown in FIG. 10A, eject ink from all ejection openings 108 in the ejection region 91 onto the conveyance belt 43 (S2: first purging operation). In the purging operation in the present embodiment, two pumps 38 corresponding to each head 1 are selectively driven, a predetermined amount of ink in the cartridges 22 is forcibly supplied to the head 1 and the ink is ejected through the ejection openings 108.

Figure 10B:
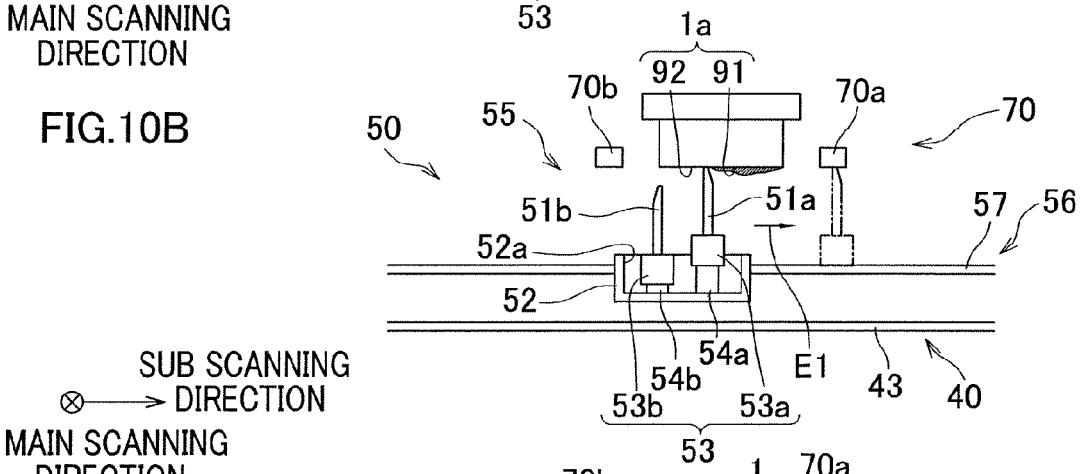

Subsequently, the maintenance controller 150 controls the heads elevating mechanism 36 to move the head 1 to the retracted position. Thereafter, as shown in FIG. 10B, the wiper unit moving mechanism 56 is controlled and the wiper unit 55 is moved from the standby position until the end of the ejection region 92 closest to the ejection region 91 opposes the wiper 51*a*, Because in the present embodiment the two ejection regions 91 and 92 partially overlap each other as shown in FIG. 7, the end of the ejection region 91 closest to the ejection region 92 exists within the ejection region 91. More specifically, in the present embodiment, the end of the ejection region 92 closest to the ejection region 91 is at the position indicated by the arrow A in FIG. 6. When the two ejection regions 91 and 92 are in proximity to each other as in the variation described above, the end of the ejection region 92 closest to the ejection region 91 is outside the ejection region 91 and upstream of the ejection region 91 in a later-described wiping direction E1.

Thereafter, the maintenance controller 150 controls the wipers elevating mechanism 53 so as to move the wiper 51*a* from the retracted position to the contact position and cause the wiper 51*a* to contact the ejection surface 1*a*. In this state, the wiper unit moving mechanism 56 is controlled so that the wiper unit 55 is moved rightward in FIG. 10B (in the wiping direction E1). In other words, the wiper 51*a* moves in the direction from the ejection region 92 toward the ejection region 91. As a result, the ink having adhered to the ejection region 91 is moved by the wiper 51*a* away from the ejection region 92 and flows into the concave portion 52*a* of the support housing 52 through the wiper 51*a*. As such, the ink having adhered to the ejection surface 1*a* in the first purging operation is removed from the ejection surface 1*a* (S3: first wiping operation).

Thereafter, when the wiper 51*a* reaches a predetermined position (indicated in FIG. 10C) after passing through the absorbent 70*a*, the maintenance controller 150 controls the wiper unit moving mechanism 56 to stop the movement of the wiper 51*a*. Before the stop, as indicated by the two-dot chain line in FIG. 10B, the ink adhering to the leading end of the wiper 51*a* is removed as the wiper 51*a* contacts the absorbent 70*a*. Thereafter, the maintenance controller 150 controls the wipers elevating mechanism 53 to move the wiper 51*a* to the retracted position.

Figure 10C:
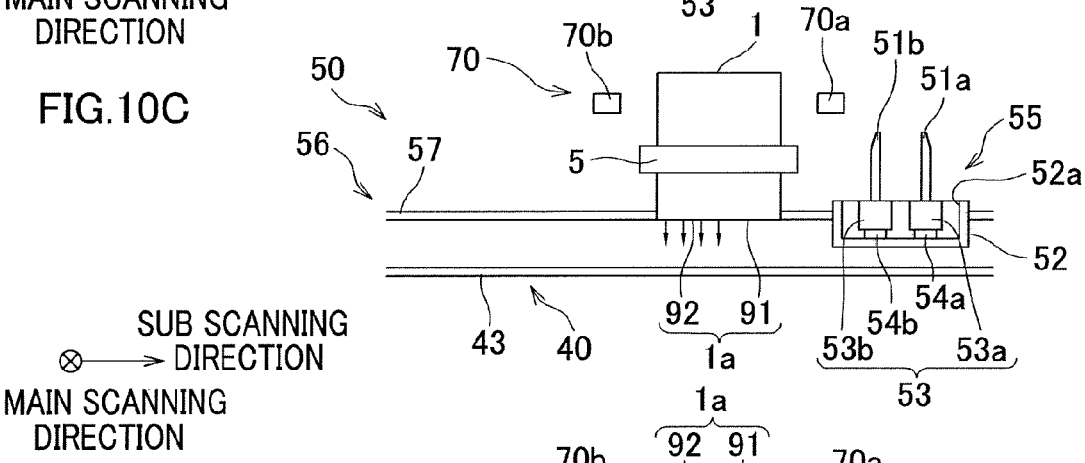

Subsequently, as shown in FIG. 10C, the maintenance controller 150 controls the heads elevating mechanism 36 to move the head 1 to the printing position. Then the pumps 38 are controlled so that the ink is ejected through the ejection openings 108 in the ejection region 92 onto the conveyance belt 43 (S4: second purging operation).

Figure 10D:
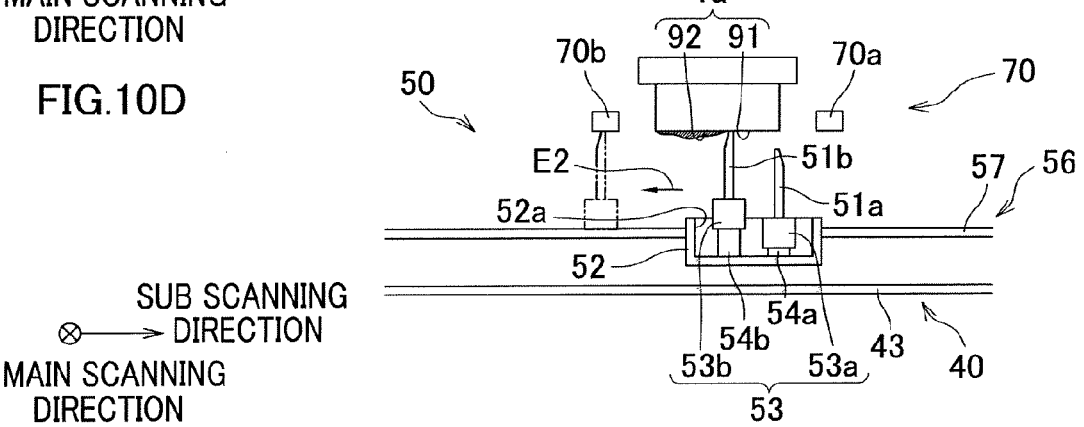

Thereafter, the maintenance controller 150 controls the heads elevating mechanism 36 so as to move the head 1 to the retracted position. Then, as shown in FIG. 10D, the wiper unit moving mechanism 56 is controlled so that the wiper unit 55 is moved from the predetermined position until the end of the ejection region 91 closest to the ejection region 92 opposes the wiper 51*b*. Because in the present embodiment two ejection regions 91 and 92 partially overlap each other as shown in FIG. 7, the end of the ejection region 91 closest to the ejection region 92 locates within the ejection region 92. More specifically, in the present embodiment, the end of the ejection region 91 closest to the ejection region 92 is at the position indicated by the arrow B in FIG. 6. When the two ejection regions 91 and 92 are in proximity to each other as in the variation above, the end of the ejection region 91 closest to the ejection region 92 is outside the ejection region 92 and upstream of the ejection region 92 in a later-described wiping direction E2.

Thereafter, the maintenance controller 150 controls the wipers elevating mechanism 53 to move the wiper 51*b* from the retracted position to the contact position and cause the wiper 51*b* to contact the ejection surface 1*a*. In this state, the wiper unit moving mechanism 56 is controlled so that the wiper unit 55 is moved leftward in FIG. 10D (in the wiping direction E2). In other words, the wiper 51*b* is moved in the direction from the ejection region 91 toward the ejection region 92. As a result, the ink adhering to the ejection region 92 is moved by the wiper 51*b* away from the ejection region 91 and flows into the concave portion 52*a* of the support housing 52 through the wiper 51*b*. As such, the ink having adhered to the ejection surface 1*a* in the second purging operation is removed from the ejection surface 1*a* (S5: second wiping operation).

When the wiper 51*b* reaches the standby position after passing through the absorbent 70*b*, the maintenance controller 150 controls the wiper unit moving mechanism 56 to stop the movement of the wiper 51*b*. Before the stop, as indicated by the two-dot chain line in FIG. 10D, the wiper 51*b* contacts the absorbent 70*b*. The ink adhering to the leading end of the wiper 51*b* is therefore removed. Thereafter, the maintenance controller 150 controls the wipers elevating mechanism 53 and the heads elevating mechanism 36 so as to return the wiper 51*b* to the retracted position and return the head 1 to the printing position.

As such, the ink having adhered to the ejection regions 91 and 92 in the first and second purging operations is wiped away from the ejection surface 1*a* without entering the ejection openings 108 ejecting ink with a different color. In the present embodiment, because as described above the two ejection regions 91 and 92 partially overlap each other and/or the two ejection regions 91 and 92 extend in a corrugated manner in the main scanning direction, the ejection region 91 has a part that is not wiped by the wiper 51*a* and the ejection region 92 has a part that is not wiped by the wiper 51*b*. However, the arrangement above is still advantageous in that color mixture is prevented in all ejection openings 108.

Thereafter, the conveyance belt 43 is cleaned by using the cleaning solution. The maintenance controller 150 controls the cleaner moving mechanism 37*c* so as to move the cleaning solution applying member 37*a* and the blade 37*b* to the contact position and controls the conveyance mechanism 40 via the conveyance controller 141 to drive the conveyance belt 43. As a result, the cleaning solution is applied to the outer circumferential surface of the conveyance belt 43 and the ejected ink on the outer circumferential surface is scraped off by the blade 37*b* together with the cleaning solution (S6: cleaning operation). In this way, the maintenance operation is completed.

As described above, in the printer 101 of the present embodiment, the ink ejected from the ejection region 91 is less likely to enter the ejection openings 108 in the ejection region 92 in the first wiping operation, and the ink ejected from the ejection region 92 is less likely to enter the ejection openings 108 in the ejection region 91 in the second wiping operation. As such, even if the two regions 91 and 92 from which inks with different colors are ejected are formed on the ejection surface 1*a*, it is possible to restrain the occurrence of color mixture in the ejection openings 108 in each of the regions 91 and 92.

In addition, subsequent to the first wiping operation, the leading end of the wiper 51*a* contacts the absorbent 70*a*. As a result, the ink is removed from the leading end of the wiper 51*a* after the first wiping operation. Because of this, in the next wiping operation, the ink having adhered to the wiper 51*a* (i.e., the ink ejected from the ejection region 91) is further less likely to enter the ejection openings 108 in the ejection region 92. Moreover, subsequent to the second wiping operation, the leading end of the wiper 51*b* contacts the absorbent 70*b*. As a result, the ink is removed from the leading end of the wiper 51*b* after the second wiping operation. Because of this, in the next wiping operation, the ink having adhered to the wiper 51*b* (i.e., the ink ejected from the ejection region 92) is further less likely to enter the ejection openings 108 in the ejection region 91.

The absorbents 70*a* and 70*b* are made of a porous material and arranged to remove ink from the leading ends of the wipers 51*a* and 51*b* when contacting the wipers 51*a* and 51*b*. The cleaning member 70 has such a simple structure and the removal of ink from the wipers 51*a* and 51*b* is easily controlled.

In the first wiping operation, after the wiper 51*a* contacts the end of the ejection region 92 closest to the ejection region 91, the wiper unit 55 is moved in the wiping direction E1 to wipe the ejection surface 1*a*. The length between the wiping start position of the ejection surface 1*a* and the upstream end of the ejection surface 1*a* is long in the wiping direction E1, the length of redundant wiping by the wiper 51*a* is short and hence the life of the wiper 51*a* is elongated. In the second wiping operation, after the wiper 51*b* contacts the end of the ejection region 91 closest to the ejection region 92, the wiper unit 55 is moved in the wiping direction E2 to wipe the ejection surface 1*a*. Because the length between the wiping start position of the ejection surface 1*a* and the upstream end of the ejection surface 1*a* is long in the wiping direction E2, the length of redundant wiping by the wiper 51*b* is short and hence the life of the wiper 51*b* is elongated.

As a variation, the wiping start position of the ejection surface 1*a* in the first wiping operation may be an arbitrary position on the ejection surface 1*a* as long as the wiping start position is upstream of the downstream end of the ejection region 91 in the wiping direction E1. Furthermore, the wiping start position of the ejection surface 1*a* in the second wiping operation may be an arbitrary position on the ejection surface 1*a* as long as the wiping start position is upstream of the downstream end of the ejection region 92 in the wiping direction E2. For example, the entirety of the first ejection region may be wiped in a traversing manner in the first wiping operation and the entirety of the second ejection region may be wiped in a traversing manner in the second wiping operation. In addition, while in the embodiment above the ejection regions 91 and 92 basically extend in the main scanning direction in a corrugated manner, the ejection regions may not be formed in this way.

The wiper 51*a* is used in the first wiping operation whereas the wiper 51*b* is used in the second wiping operation. As such, the wipers 51*a* and 51*b* for wiping the ink ejected from the ejection regions 91 and 92 away from the ejection surface 1*a* are exclusive for the ejection regions 91 and 92, respectively. This restrains each of the ejection regions 91 and 92 from being wiped by a wiper to which ink with a different color adheres.

Other variations of the embodiment above will be described. While in the embodiment above the two wipers 51*a* and 51*b* are used for wiping a single ejection surface 1*a*, the ejection surface may be wiped by using only one wiper. Also in this case, ink ejected from the ejection region 91 is less likely to enter the ejection openings 108 in the ejection region 92 in the first wiping operation, and ink ejected from the ejection region 92 is less likely to enter the ejection openings 108 of the ejection region 91 in the second wiping operation. This makes it possible to restrain the color mixture in the ejection openings 108 in the regions 91 and 92.

In addition to the above, the ink having adhered to the wipers 51*a* and 51*b* may be removed either by moving the cleaning member 70 or by moving both the cleaning member 70 and the wipers 51*a* and 51*b*. Furthermore, the cleaning member 70 may be made of a material different from a porous material such as sponge. Alternatively, the cleaning member 70 may not be provided.

In addition to the above, while in the wiper unit moving mechanism 56 of the embodiment above the wipers 51*a* and 51*b* are moved in the sub-scanning direction, the moving mechanism may move the head 1 or move the wipers 51*a* and 51*b* and the head 1 relative to one another.

The present invention is applicable not only to printers but also to facsimile machines, photocopiers, or the like. The recording medium is not limited to the sheet P. Various types of recordable media may be used as the recording medium. Furthermore, the present invention is applicable irrespective of the ink ejection method. For example, while in the present embodiment the piezoelectric elements are used, the ink ejection method may be a resistance heating method or a capacitive sensing method.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet recording apparatus comprising:

an inkjet head having an ejection surface on which a first ejection region, where a plurality of ejection openings that are configured to eject ink are disposed at equal intervals in one direction, and a second ejection region, where a plurality of ejection openings that are configured to eject ink with a color different from a color of the ink ejected from the first ejection region are disposed at equal intervals in the one direction, are formed to be in proximity to each other or to partially overlap each other in the orthogonal direction orthogonal to the one direction;

a wiping unit including a wiping member that is configured to wipe the ejection surface and a moving mechanism that is configured to move at least one of the wiping member, and the inkjet head relative to each other in the orthogonal direction along the ejection surface while keeping the wiping member to contact the ejection surface;

a forcible ejection unit that is configured to selectively and forcibly eject the ink from the first ejection region and the second ejection region by supplying the ink to the inkjet head; and a controller that is configured to control the wiping unit and the forcible ejection unit, wherein the controller is configured to selectively perform:

a first wiping operation in which, after the ink is forcibly ejected only from the first ejection region, the first ejection region is wiped by relative movement of the wiping member in a direction from the second ejection region toward the first ejection region; and a second wiping operation in which, after the ink is forcibly ejected only from the second ejection region, the second ejection region is wiped by relative movement of the wiping member in a direction from the first ejection region toward the second ejection region.

2. The inkjet recording apparatus according to claim 1, further comprising:

a cleaning unit that is configured to remove the ink adhering to the wiping member, wherein the controller is configured to control at least one of the cleaning unit and the wiping unit to remove the ink from the wiping member after the first wiping operation.

3. The inkjet recording apparatus according to claim 2, wherein, the controller is configured to control at least one of the cleaning unit and the wiping unit to remove the ink from the wiping member after the second wiping operation.

4. The inkjet recording apparatus according to claim 2, wherein, the cleaning unit is made of a porous material capable of absorbing the ink, and wherein the controller is configured to control the wiping unit to cause the wiping member to contact the porous material when the ink is removed from the wiping member.

5. The inkjet recording apparatus according to claim 1, wherein, in the first wiping operation, the controller is configured to control the wiping unit so that the wiping member moves along the ejection surface after causing the wiping member to contact an end of the second ejection region, such end being closest to the first ejection region.

6. The inkjet recording apparatus according to claim 1, wherein, in the second wiping operation, the controller is configured to control the wiping unit so that the wiping member moves along the ejection surface after causing the wiping member to contact an end of the first ejection region which end is closest to the second ejection region.

7. The inkjet recording apparatus according to claim 1, wherein, the wiping member includes two wipers and a wiper moving mechanism that is configured to selectively move the two wipers in the direction orthogonal to the ejection surface, and wherein the controller is configured to control the wiper moving mechanism so that one of the wipers contacts the ejection surface in the first wiping operation whereas the other one of the wipers contacts the ejection surface in the second wiping operation.

* * * * *